US007522873B2

(12) United States Patent
Motoyama et al.

(10) Patent No.: US 7,522,873 B2
(45) Date of Patent: Apr. 21, 2009

(54) IMAGE FORMING APPARATUS, METHOD FOR CONTROLLING THE SAME, AND PROGRAM

(75) Inventors: Eiichi Motoyama, Shinjuku-ku (JP); Kuniyasu Kimura, Toride (JP); Hiroaki Tomiyasu, Toride (JP); Yuichi Yamamoto, Abiko (JP); Takahiko Yamaoka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 11/271,642

(22) Filed: Nov. 10, 2005

(65) Prior Publication Data

US 2006/0104688 A1 May 18, 2006

(30) Foreign Application Priority Data

Nov. 15, 2004 (JP) ..... 2004-330997

(51) Int. Cl.
*G03G 15/00* (2006.01)

(52) U.S. Cl. ..... 399/396; 399/389

(58) Field of Classification Search ..... 399/396, 399/389

See application file for complete search history.

(56) References Cited

U.S. PATENT DOCUMENTS 4,860,119 A * 8/1989 Maniwa et al. ..... 358/296
4,924,320 A * 5/1990 Tanaka et al. ..... 358/296
4,935,771 A * 6/1990 Ito ..... 355/66
5,170,265 A * 12/1992 Kotabe ..... 358/468
5,689,760 A * 11/1997 Suzuki et al. ..... 399/45
5,757,509 A * 5/1998 Kubo ..... 358/296
6,340,804 B1 * 1/2002 Tamamoto et al. ..... 209/584
6,701,099 B2 * 3/2004 Yokobori et al. ..... 399/45
7,187,467 B2 * 3/2007 Takahashi et al. ..... 358/1.18
2002/0044809 A1 * 4/2002 Hayashi et al. ..... 399/391

FOREIGN PATENT DOCUMENTS

JP 05-000538 1/1993
JP 05-068977 U 9/1993
JP 08-328445 12/1996

* cited by examiner

*Primary Examiner*—Anthony H. Nguyen
(74) *Attorney, Agent, or Firm*—Canon USA, Inc IP Div.

(57) ABSTRACT

An image forming apparatus includes an image forming apparatus body and a peripheral unit operable to transport a recording medium. The image forming apparatus includes a communication device for communicating with the peripheral unit and a controller for controlling transporting the recording medium by the peripheral unit using a communication by the communication device. The controller sets a plurality of transport speeds, each of which corresponds to a predetermined identification code, to the peripheral unit and specifies the transport speed by using the predetermined identification code to the peripheral unit.

8 Claims, 10 Drawing Sheets

IMAGE FORMING APPARATUS, METHOD FOR CONTROLLING THE SAME, AND PROGRAM

BACKGROUND OF THE INVENTION

1. Field of the Invention

The present invention relates to an image forming apparatus, such as a copier and a printer, a method for controlling the image forming apparatus, and a program and, in particular, to technology for setting a transport speed of a recording medium to a peripheral unit, such as a paper feeder unit.

2. Description of the Related Art

Known is an image forming apparatus that includes a plurality of paper feeder units for selectively feeding recording media (recording paper) of different types having different sizes and materials. Also, some image forming apparatuses optionally provide the paper feeder units of this type in order to reduce user costs.

Such an optional paper feeder unit has been developed for each type of image forming apparatus due to differences between transport speeds and between transfer sequences of recording paper in the main bodies of the image forming apparatuses. However, in recent years, a variety of methods for setting a transport speed has been discussed to commonly use the optional paper feeder unit in a variety of image forming apparatuses having different transport speeds as follows.

For example, Japanese Patent Laid-Open No. 05-000538 discloses technology in which an image forming apparatus instructs a transport speed to an optional paper feeder unit each time recoding paper is fed and technology in which a transport speed is switched by a dip switch mounted on the optional paper feeder unit. Additionally, Japanese Patent Laid-Open No. 08-328445 discloses technology in which data concerning overall system control including a moving speed of a photoconductor, positional information about paper sensors and a registration roller in a paper transfer path, a paper feed speed, and a paper transport speed are transmitted to an optional paper feeder unit in advance. Furthermore, Japanese Unexamined Utility Model Registration Application Publication No. 05-068977 discloses technology in which, when optional paper feeder units in different tiers have different transport speeds, the transport speeds are determined in advance.

However, in the technology in which a transport speed is instructed each time recoding paper is fed, the time for instructing the transport speed is required, and therefore, the transfer control cannot be speeded up. In the technology in which a transport speed is switched by a dip switch, complex software for supporting the transport speeds and transfer sequences for a plurality of models is required in the main body of the image forming apparatus, and therefore, an amount of memory for the software increases and the cost increases.

In the technology in which data concerning overall system control is transmitted to an optional paper feeder unit in advance, complex software for analyzing the data while considering all data for the control is required in the optional paper feeder unit, and therefore, the cost increases.

Still furthermore, in the above-described known technologies, it is sometimes difficult for the image forming apparatus itself to change a transport speed and a transfer sequence in accordance with the type of recording paper (e.g., a material and a size) and the performance of forming an image (e.g., a resolution and a color mode).

SUMMARY OF THE INVENTION

The present invention is directed to an image forming apparatus, a method for controlling the image forming apparatus, and a program that can set a plurality of transport speeds to a peripheral unit having a function to transport a recording medium at low cost and that can form an image at high speed.

According to one aspect of the present invention, an image forming apparatus connectable to a peripheral unit operable to transport a recording medium includes a communication device facilitating communication with the peripheral unit, and a controller controlling transporting the recording medium by the peripheral unit using communication from the communication device. The controller sets a plurality of transport speeds, each of which corresponds to a predetermined identification code, to the peripheral unit and specifies the transport speed by using the predetermined identification code to the peripheral unit.

According to another aspect of the present invention, a method for controlling an image forming apparatus that can be connected to a peripheral unit operable to transport a recording medium includes the steps of (a) communicating with the peripheral unit and (b) controlling transporting the recording medium by the peripheral unit using a communication in step (a). Step (b) includes (c) setting a plurality of transport speeds, each of which corresponds to a predetermined identification code, to the peripheral unit and (d) specifying to the peripheral unit the transport speed by using the predetermined identification code.

According to yet another aspect of the present invention, a program for performing the method for controlling an image forming apparatus is provided.

Further features of the present invention will become apparent from the following description of exemplary embodiments with reference to the attached drawings.

DESCRIPTION OF THE EMBODIMENTS

Figure 1:
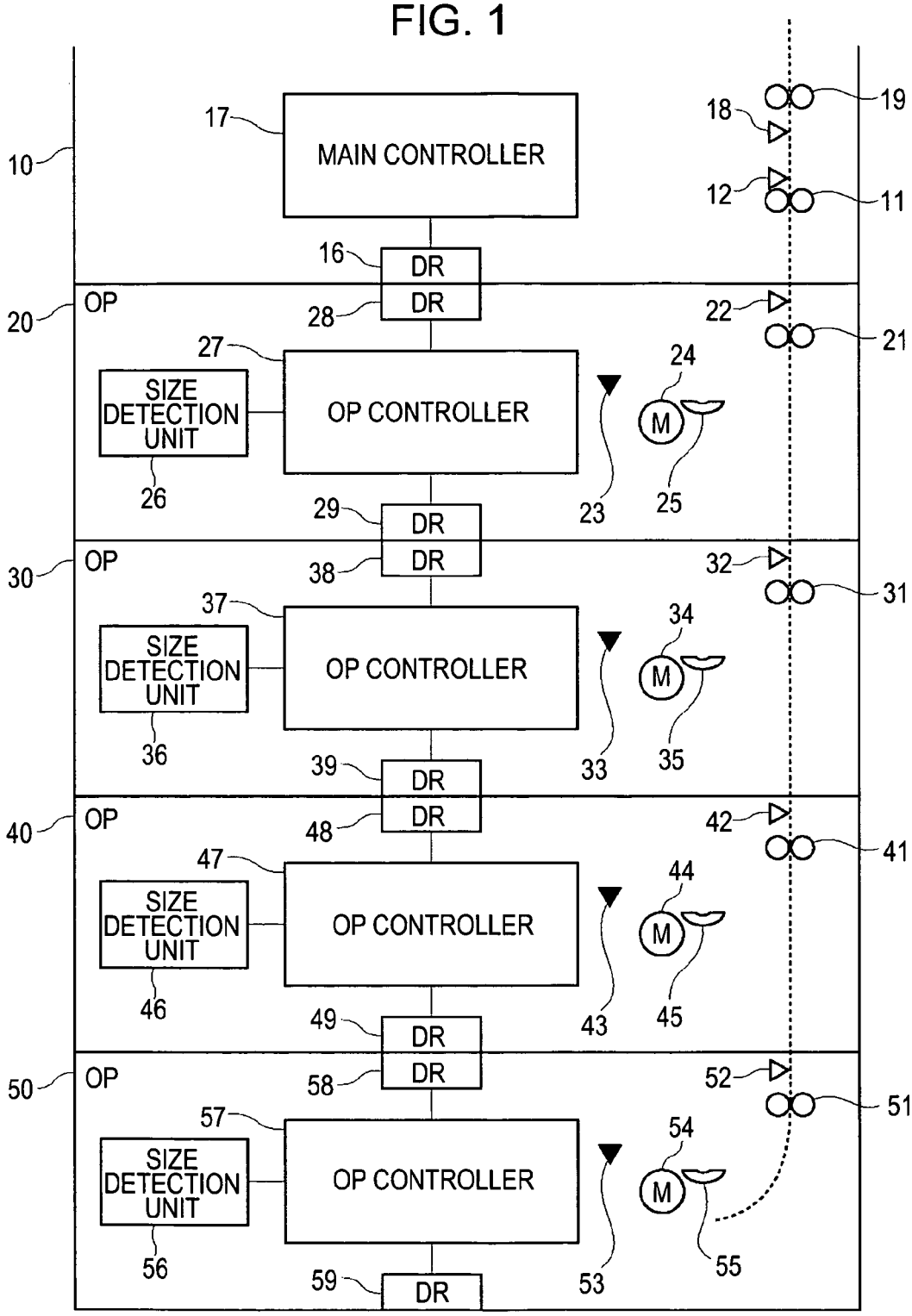
FIG. 1 is a block diagram of an imaging apparatus according to an embodiment of the present invention.

Exemplary embodiments of the present invention are described below with reference to the accompanying drawings. FIG. 1 illustrates a block diagram of an image forming apparatus according to an embodiment of the present invention, in which a part of the image forming apparatus body 10 and optional paper feeder units 20, 30, 40, and 50 are shown. In FIG. 1, a dashed line indicates a transport path of a recording paper sheet when the recording paper sheet is fed from the optional paper feeder unit 50, which is disposed at the bottom tier.

The image forming apparatus body 10 includes a main feeder unit, an electrophotographic image forming unit, and a paper transport path (none are shown). A pull-out roller 11 pulls out a recording paper sheet picked up from a feeder tray (not shown) of the main feeder unit. The pull-out roller 11 also functions as a transport roller for transporting a recording paper sheet delivered from the optional paper feeder units 20, 30, 40, and 50. A main feeder sensor 12 monitors whether the transport timing of a recording paper sheet transported by the pull-out roller 11 is adequate or not.

The image forming apparatus body 10 further includes a pre-registration sensor 18, a registration roller 19, and a drawer connector 16 for connecting the image forming apparatus body 10 to the optional paper feeder units 20, 30, 40, and 50 by simply topping the image forming apparatus body 10 on the optional paper feeder units 20, 30, 40, and 50.

A main controller 17, which is described below, stops the rotation of the registration roller 19 and resumes the rotation of the registration roller 19 after a predetermined time period has elapsed after the pre-registration sensor 18 has detected the recording paper sheet. Thus, the skew of the recording paper sheet is corrected and the timing of forming a transfer image to be transferred on the recording paper sheet is consistent with the timing of transporting the recording paper sheet to the transfer position. The main controller 17 carries out a variety of controls of each component of the image forming apparatus body 10 and the optional paper feeder unit 20, 30, 40, and 50.

The optional paper feeder units 20, 30, 40, and 50 have the same structure, and therefore, only the optional paper feeder unit 20 is described here.

A pickup roller 21 (corresponds to components 31, 41 and 51) extracts a recording paper sheet from a feeder tray (not shown) of the optional paper feeder unit 20. The pickup roller 21 also functions as a transport roller for transporting a recording paper sheet delivered from the optional paper feeder unit at a lower tier. An optional (OP) feeder sensor 22 (corresponds to components 32, 42 and 52) monitors whether the transport timing of the recording paper sheet transported by the pickup roller 21 is adequate or not. A paper presence sensor 23 (corresponds to components 33, 43 and 53) detects whether recording paper sheets are loaded in the feeder tray of the optional paper feeder unit 20.

A motor 24 (corresponds to components 34, 44 and 54) serves as a drive motor of a variety of rollers for feeding and transporting a recording paper sheet in the optional paper feeder unit 20. A solenoid 25 (corresponds to components 35, 45 and 55) causes a pick-up roller (not shown) to be brought into contact with the recording paper sheet on the feeder tray in order to pick up the recording paper sheet, or causes the pick-up roller to release the contact with the recording paper sheet in order to stop the pick-up operation. By controlling the contact between the recording paper sheet on the feeder tray and the pick-up roller, it can be switched whether a recording paper sheet is fed from the optional paper feeder unit 20 or a recording paper sheet from the optional paper feeder unit at a lower tier is simply transported.

An OP controller 27 communicates with the image forming apparatus body 10 to control each component of the optional paper feeder unit 20. The OP controller 27 recognizes the size of the recording paper sheet set on the feeder tray of the optional paper feeder unit 20 by using a size detection unit 26 (corresponds to components 36, 46 and 56). An upper drawer connector 28 (corresponds to components 38, 48, and 58) is electrically connected to the image forming apparatus body 10 or is connected to an optional paper feeder unit at an upper tier. A lower drawer connector 29 (corresponds to components 39, 49 and 59) is electrically connected to an optional paper feeder unit at a lower tier.

The main controller 17 of the image forming apparatus body 10 includes a microcomputer. Each of the OP controller 27 and OP controllers 37, 47, and 57 also includes a microcomputer. Each of the microcomputers includes a central processing unit (not shown) and a variety of memories. The memories store an operating system and application programs that execute a process according to this embodiment, which is described below.

In such a structure, the main controller 17 of the image forming apparatus body 10 communicates with the OP controllers 27, 37, 47, and 57 of the optional paper feeder units 20, 30, 40, and 50 to set a plurality of transport speeds to each of the optional paper feeder units 20, 30, 40, and 50. When carrying out an image forming operation, the main controller 17 specifies a transport speed by using a speed identification (ID) number (a speed code or an identification code) assigned to each transport speed.

Figure 2:
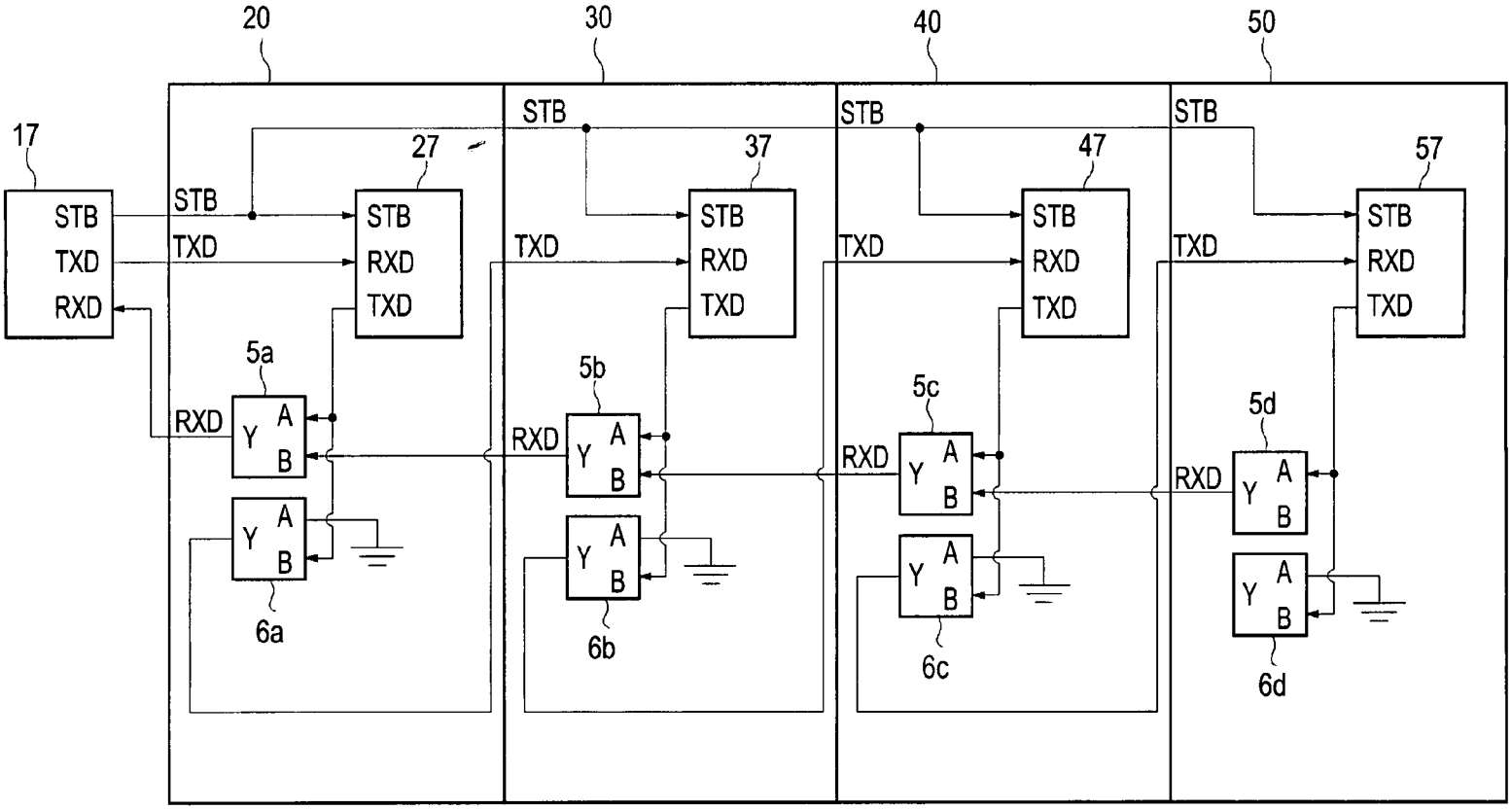
FIG. 2 illustrates a communication system between an image forming apparatus body and an optional paper feeder unit.

FIG. 2 illustrates a communication system between the image forming apparatus body 10 and the optional paper feeder units 20, 30, 40, and 50. The main controller 17 performs a packet communication with the OP controllers 27, 37, 47, and 57 via serial lines using a relay mode. The main controller 17 outputs a strobe (STB) signal to the OP controllers 27, 37, 47, and 57 with a packet communication to validate TXD data (transmission packet) and RXD data (reception packet).

The optional paper feeder units 20, 30, 40, and 50 include RXD data selectors 5*a*, 5*b*, 5*c*, and 5*d* and TXD data selectors 6*a*, 6*b*, 6*c*, and 6*d* in addition to the OP controllers 27, 37, 47, and 57, respectively. "A" terminals of the TXD data selectors 6*a*, 6*b*, 6*c*, and 6*d* are connected to ground.

The main controller 17 transmits serial TXD data and subsequently asserts the STB signal to instruct the OP controllers 27, 37, 47, and 57 to validate the TXD data. The OP controllers 27, 37, 47, and 57 instructed by the STB signal to validate the TXD data receive the current serial TXD data as data transmitted thereto.

For example, when a transport speed is set to the optional paper feeder unit 50, the transport speed information (TXD data) is relayed in the following order:

(1) a TXD terminal of the main controller 17

(2) an RXD terminal and a TXD terminal of the OP controller 27

(3) a B terminal and a Y terminal of the TXD data selector 6*a*

(4) an RXD terminal and a TXD terminal of the OP controller 37

(5) a B terminal and a Y terminal of the TXD data selector 6*b*

(6) an RXD terminal and a TXD terminal of the OP controller 47

(7) a B terminal and a Y terminal of the TXD data selector 6*c*

(8) an RXD terminal of the OP controller 57.

In this case, the main controller 17 asserts the STB signal when the TXD data is transferred to the OP controller 57 of the optional paper feeder unit 50. The OP controller 57 receives the transport speed information (TXD data) in response to the asserted STB signal.

When transmitting the TXD data to the optional paper feeder unit 40, the main controller 17 asserts the STB signal at a timing when the TXD data is transferred to the OP controller 47 of the optional paper feeder unit 40. The OP controller 47 receives the TXD data from the RXD terminal in response to the asserted STB signal (the same for the optional paper feeder unit 30 or 20 when transmitting TXD data). Precisely speaking, the main controller 17 always transmits TXD data for the optional paper feeder units at all tiers and asserts an STB signal. That is, the main controller 17 transmits TXD data for the OP controller 57 first and subsequently transmits TXD data for the OP controller 47. Similarly, the main controller 17 transmits TXD data for the OP controller 37 and subsequently transmits TXD data for the OP controller 27. When the TXD data reaches the OP controller 57, the main controller 17 asserts the STB signal.

Additionally, for example, when the optional paper feeder unit 50 replies, the reply data (RXD data) is relayed in the following order:

(1) a TXD terminal of the OP controller 57

(2) an A terminal and a Y terminal of the RXD data selector 5*d*

(3) a B terminal and a Y terminal of the RXD data selector 5*c*

(4) a B terminal and a Y terminal of the RXD data selector 5*b*

(5) a B terminal and a Y terminal of the RXD data selector 5*a*

(6) an RXD terminal of the main controller 17.

In this embodiment, each of the OP controllers 27, 37, 47, and 57 does not voluntarily transmit data to the main controller 17. Only when each of the OP controllers 27, 37, 47, and 57 receives data from the main controller 17, it transmits reply data to the main controller 17. That is, each of the OP controllers 27, 37, 47, and 57 transmits the replay data (RXD data) to the main controller 17 in response to an STB signal asserted thereto.

The A terminals of the RXD data selectors 5*a*, 5*b*, and 5*c* receive reply data from the OP controllers 27, 37, and 47 of the optional paper feeder units 20, 30, and 40, to which the RXD data selectors 5*a*, 5*b*, and 5*c* belong, respectively. Reply data from the OP controllers 37, 47, and 57 of the optional paper feeder units 30, 40, and 50 at the lower tiers are input into the B terminals. When the OP controllers 27, 37, and 47 transmit replay data (RXD data) to the main controller 17 on the basis of the STB signals asserted thereto, the OP controllers 27, 37, and 47 transmit data at the A terminals thereof. When the OP controllers 27, 37, and 47 transfer reply data from the optional paper feeder units at the lower tiers, the OP controllers 27, 37, and 47 switch the selectors 5*a*, 5*b*, and 5*c* to output data at the B terminals thereof.

The optional paper feeder unit 50 at the top tier need not transfer replay data received from the optional paper feeder unit at the lower tiers. Therefore, the OP controller 57 always sets the selector 5*d* so as to output data at the A terminal thereof.

A packet used for communication between the main controller 17 and each of the OP controllers 27, 37, 47, and 57 is described next.

Figure 3:
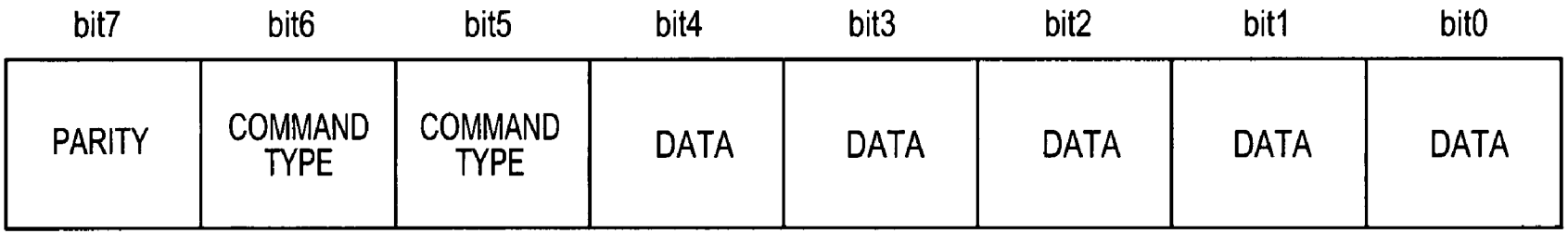
FIG. 3 illustrates the basic structure of a packet.

FIG. 3 illustrates the basic structure of the packet used for communication between the main controller 17 and each of the OP controllers 27, 37, 47, and 57. The packet has eight (8) bits, in which five (5) bits are used for data, two (2) bits are used for a command, and one (1) bit is used for parity check.

Figure 4A:
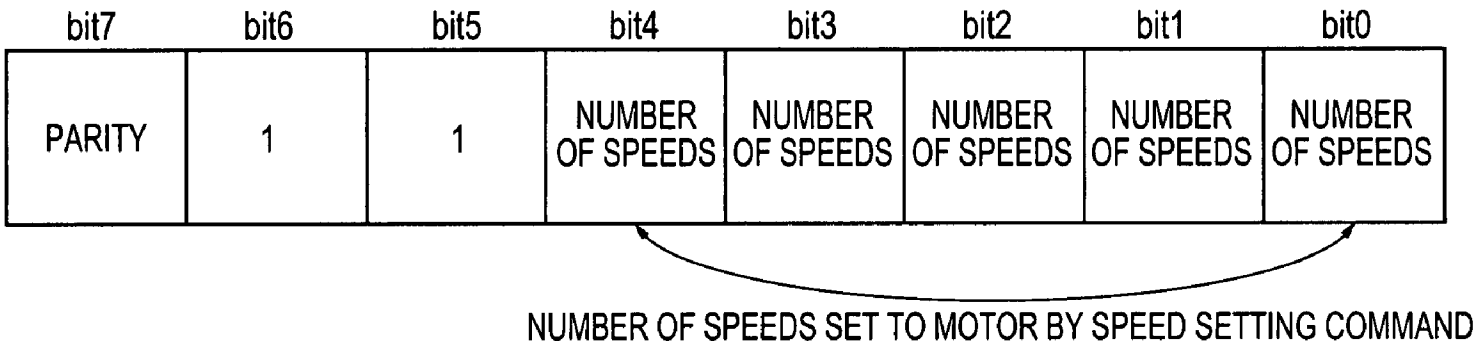
FIG. 4A illustrates the structure of a packet associated with an initialization command.
Figure 4B:
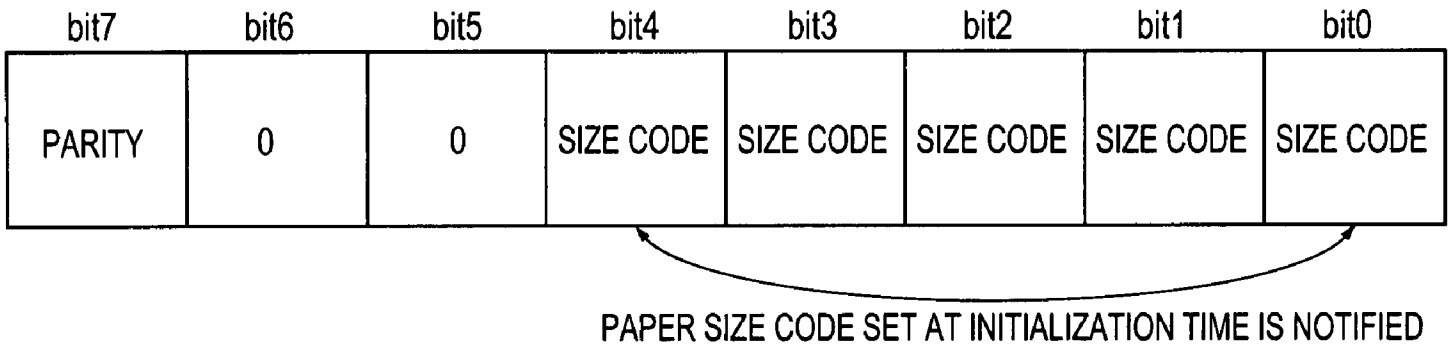
FIG. 4B illustrates the structure of an initialization reply packet in response to the initialization command.

FIGS. 4A and 4B illustrate the structure of a packet associated with initialization communication. FIG. 4A illustrates the structure of a packet associated with an initialization command transmitted from the main controller 17 to the OP controllers 27, 37, 47, and 57. The command in bits 6 to 5 is "11". The data in bits 4 to 0 indicates "the number of speeds". The number of speeds represents the number of transport speeds of the recording paper sheet which the image forming apparatus body 10 can control. Transport speeds for the number of speeds are set to the motor 24, and motors 34, 44, and 54 of the respective optional paper feeder units 20, 30, 40, and 50.

For example, when the main controller 17 is powered on or the main controller 17 starts an image forming process, the main controller 17 transmits the packet used for the initialization command shown in FIG. 4A to each of the OP controllers 27, 37, 47, and 57. In this case, the main controller 17 does not know how many optional paper feeder units (i.e., tiers) are connected to the main controller 17. Accordingly, the main controller 17 sends packets associated with the initialization command the number of times defined by the maximum tier number (four tiers in this embodiment). Every time the main controller 17 sends the packet, the main controller 17 asserts an STB signal. Thereafter, the main controller 17 recognizes how many optional paper feeder units are connected thereto by counting the number of reply packets in response to the initialization commands.

FIG. 4B illustrates the structure of the reply packet returned from each of the OP controllers 27, 37, 47 and 57 to the main controller 17 in response to the initialization command. The command in bits 6 to 5 is "00". The data in bits 4 to 0 indicates a "size code". The size code represents the sizes of the recording paper sheets set on the feeder trays of the optional paper feeder units 20, 30, 40, and 50 at initialization time. The sheet sizes can be detected by the size detection unit 26 and size detection units 36, 46, and 56.

Figure 5A:
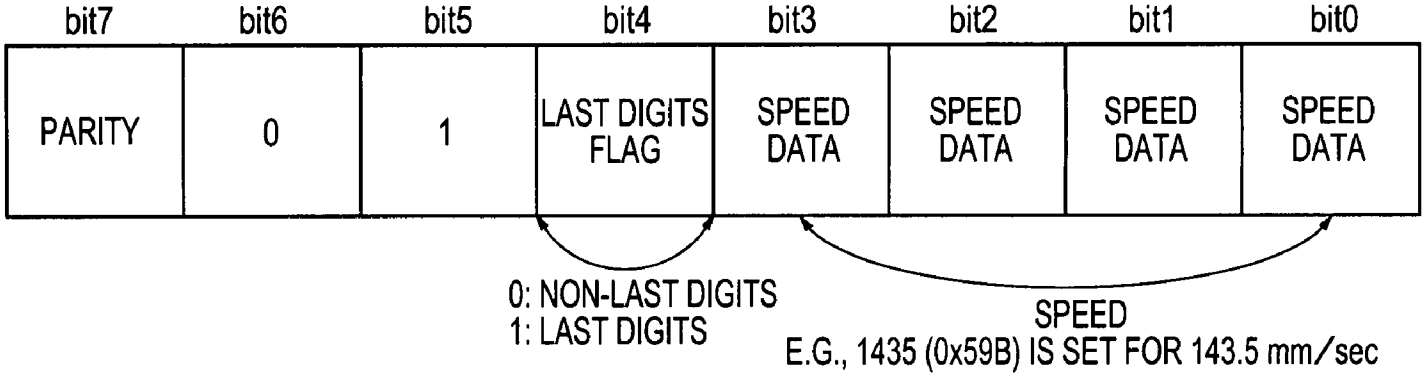
FIG. 5A illustrates the structure of a packet associated with a speed setting command.

After the main controller 17 recognizes the number of the optional paper feeder units connected thereto, the main controller 17 sends a packet associated with a speed setting command shown in FIG. 5A to the OP controller of each of the optional paper feeder units connected thereto. The command in bits 6 to 5 is "01". Bit 4 represents the "last digits flag". The data in bits 3 to 0 indicates "speed data".

In this embodiment, the speed data is represented by 12 bits (i.e., the maximum transport speed is, for example, 4000 mm/sec) although one packet associated with the speed setting command contains speed data for 4 bits. Therefore, to transmit speed data for one speed to each optional paper feeder unit, the packet shown in FIG. 5A is transmitted three times. That is, the main controller 17 transmits the speed data composed of a set of three packets the number of times defined by "the number of speeds × the number of connected tiers".

In this case, "the last digits flag" is set to "1" in only the third (i.e., final) packet of the set of three packets. The "last digits flag" in each of the first and second packets in the set is set to "0". This design adopting the "last digits flag" allows the speed data to be represented by 13 bits or more. By containing four or more packets in the one set, a higher transport speed can be specified.

Additionally, for example, the main controller 17 assigns a speed ID number "1" to the speed data transmitted first and assigns a speed ID number "2" to the speed data transmitted second, and so on. That is, the main controller 17 assigns the speed ID number (speed code) corresponding to the order of setting the speed data (i.e., the order of transmission) to each speed. However, the main controller 17 does not transmit the speed ID numbers to the OP controllers 27, 37, 47, and 57. More specifically, every time each of the OP controllers 27, 37, 47, and 57 receives speed data consisting of the set of three packets, each of the OP controllers 27, 37, 47, and 57 recognizes the order of reception of the speed data and stores the speed data in association with the recognized order of reception.

Every time each of the OP controllers 27, 37, 47, and 57 receives a packet associated with the speed setting command, each of the OP controllers 27, 37, 47, and 57 directly returns the received packet associated with the speed setting command to the main controller 17 as a reply packet (see FIG. 5B) without altering the packet. Since the received packet associated with the speed setting command is directly returned to the main controller 17, the main controller 17 can precisely check a communication error, namely, incorrect settings in the speed data.

Thus, the main controller 17 recognizes the number of connected optional paper feeder units and the sizes of the recording paper sheets set on the optional paper feeder units and then sets a plurality of transport speeds to the connected optional paper feeder units. Thereafter, the main controller 17 sets an actual transport speed used for an image forming process to an optional paper feeder unit in which recording paper sheets having a size specified by an operation unit (not shown) are loaded.

Figure 6A:
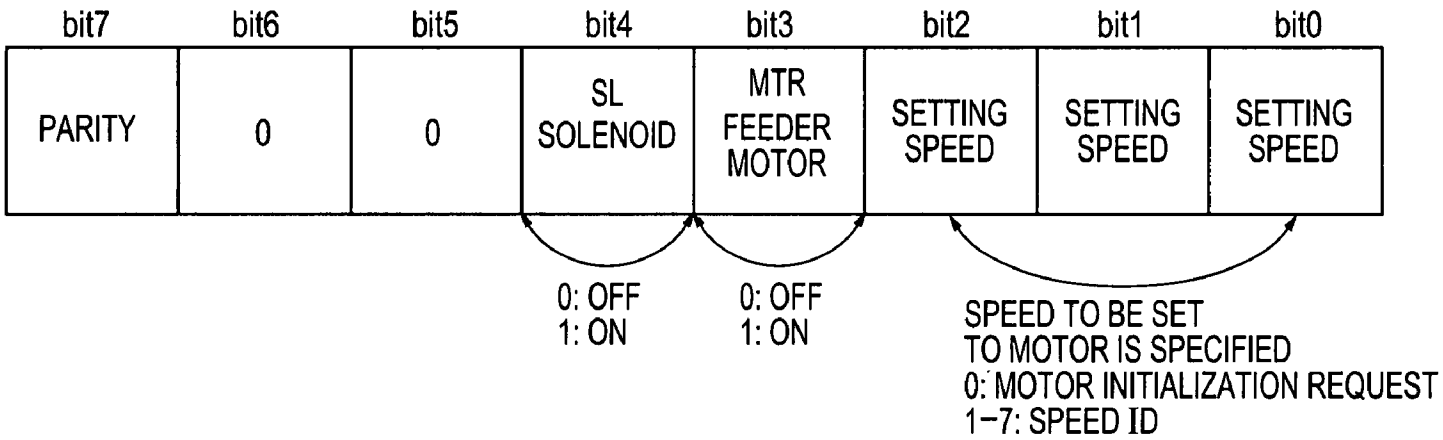
FIG. 6A illustrates the structure of a packet associated with a normal command.

This transport speed is specified by using a packet associated with a normal command shown in FIG. 6A. In the packet associated with the normal command, the speed setting command in bits 6 to 5 is "00". Bit 4 represents "solenoid ON/OFF". Bit 3 represents "motor ON/OFF". Bits 2 to 0 represent "setting speed". In bit 4 of "solenoid ON/OFF" and bit 3 of "motor ON/OFF", a bit value of "0" indicates "OFF" and a bit value of "1" indicates "ON".

When the solenoids 25, 35, 45, and 55 are turned on, the pick-up rollers are brought into contact with recording paper sheets. In a default mode, the solenoids 25, 35, 45, and 55 are turned off.

In the "setting speed" in bits 2 to 0, the actual speed data is not stored. Instead, the speed ID number assigned to the speed data is stored. That is, if three bits (bits 2 to 0) are used to indicate a setting speed and the speed data of 12 bits is specified, four packets associated with a normal command are required to be transmitted.

However, as in this embodiment, if the speed is represented by a speed ID number, eight types of speeds among speeds represented by 12 bits can be selectively specified, that is, one of the eight types of speeds can be selected. If a value "0" in the three bits (bits 2 to 0) is defined as a motor initialization request, seven types of speeds can be selectively specified.

In other words, when an image is formed, an amount of communication can be reduced by specifying a speed using the speed ID number. As a result, the image can be formed at high speed.

The mode "motor OFF" is defined as one of speeds and the dedicated bit for "motor ON/OFF" is eliminated so as to use four bits from bit 3 to 0 for the specification of a setting speed. In this case, even if a value "0" of four bits from bit 3 to 0 is defined as a motor initialization request, fifteen types of speeds can be selectively specified in a packet associated with the normal command.

Figure 6B:
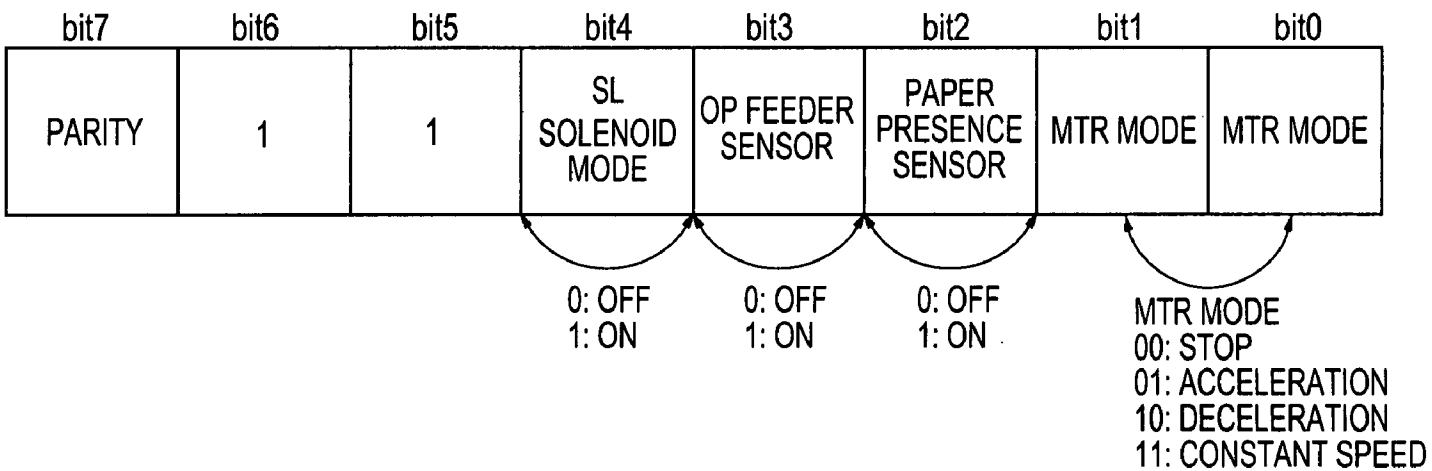
FIG. 6B illustrates the structure of a normal status reply packet in response to the normal command.

The OP controller (one of the OP controllers 27, 37, 47, and 57) that has received a packet associated with a normal command shown in FIG. 6A from the main controller 17 returns a reply packet shown in FIG. 6B to the main controller 17. In the reply packet, a command in bits 6 to 5 is "11". Bit 4 represents "solenoid ON/OFF". Bit 3 represents "OP feeder sensor ON/OFF". Bit 2 represents "paper presence sensor ON/OFF". Bits 1 to 0 represent "motor mode".

In bit 4 of "solenoid ON/OFF", bit 3 of "OP feeder sensor ON/OFF", and bit 2 of "paper presence sensor ON/OFF", a bit value "0" indicates "OFF" and a bit value "1" indicates "ON". In bits 1 to 0 of "motor mode", "00" indicates "stop", "01" indicates "acceleration", "10" indicates "deceleration", and "11" indicates "constant speed".

Figure 7A:
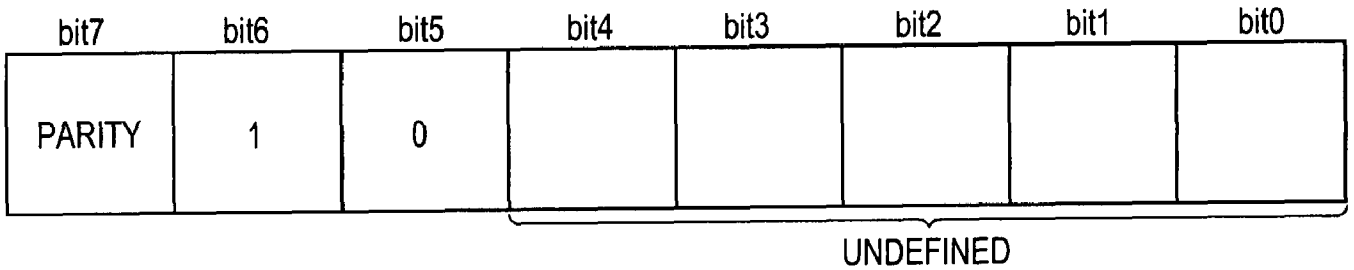
FIG. 7A illustrates the structure of a packet associated with a size request command.

FIG. 7A illustrates the structure of a packet associated with a size request command used for requesting the size of a recording paper sheet set on an optional feeder unit connected to the main controller 17. In the packet associated with a size request command, a command in bits 6 to 5 is "10" and bits 4 to 0 are undefined.

Figure 7B:
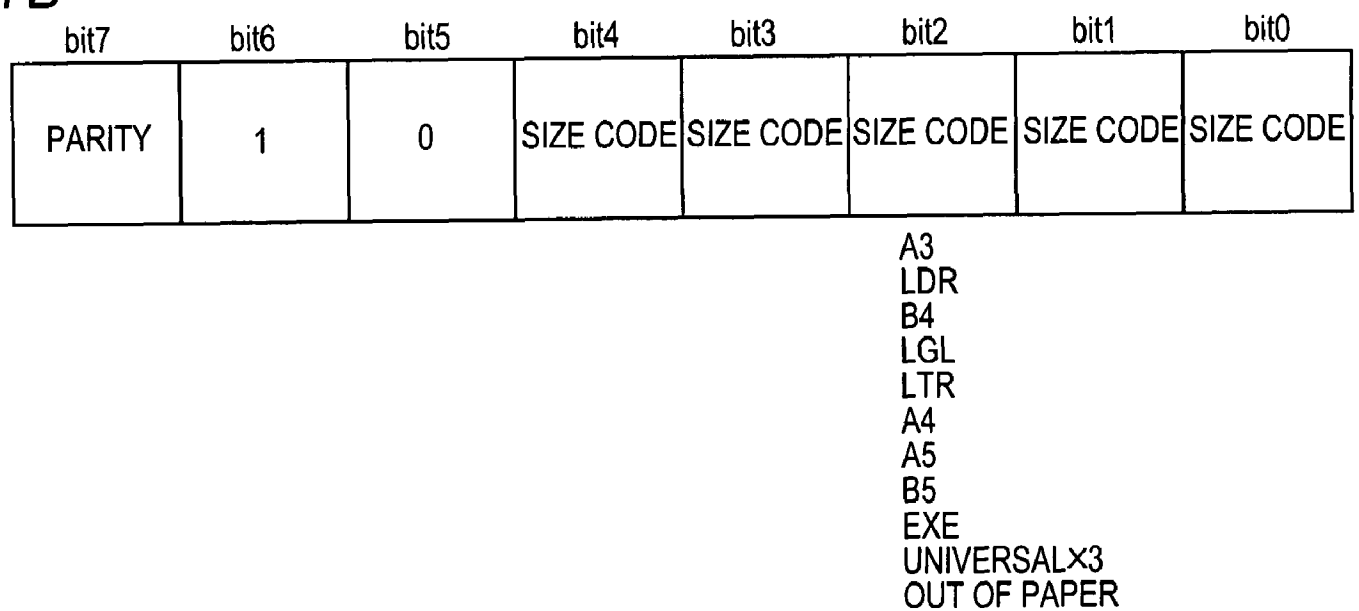
FIG. 7B illustrates the structure of a size request reply packet in response to the size request command.

FIG. 7B illustrates the structure of a reply packet returned by the OP controller in response to the packet associated with a size request command. In the reply packet, a command in bits 6 to 5 is "10". Bits 4 to 0 represents "size code". The sizes of the recording paper sheet include A3, LDR, B4, LGL, LTR, A4, A5, B5, EXE, UNIVERSAL×3, and "out of paper".

After the main controller 17 carries out the initialization communication process by using the packets shown in FIGS. 4 and 5, the main controller 17 appropriately communicates using the normal packet used for speed setting shown in FIG. 6 or the packet used for a size request shown in FIG. 7. For example, the main controller 17 alternately transmits the normal packet for speed setting and the packet for a size request when an image is not formed (i.e., in a standby mode). The main controller 17 monitors the states of the solenoids, the OP feeder sensors, the paper presence sensors, and the size detection units on the basis of reply packets in response to the packets. During an image forming process in which the paper size is, not changed, the main controller 17 transmits only normal commands.

However, to change the size of a recording paper sheet when an image is formed, the main controller 17 appropriately selects the normal packet for speed setting or the packet for a size request to transmit it even when an image is formed. For example, this scheme is applied to a case where a recording paper sheet having an A3 size is used for a first cover recording paper sheet (when a front cover and a back cover are recorded on one sheet) and the images for pages subsequent from the second page are recorded on recording paper sheets having an A4 size.

Figure 8:
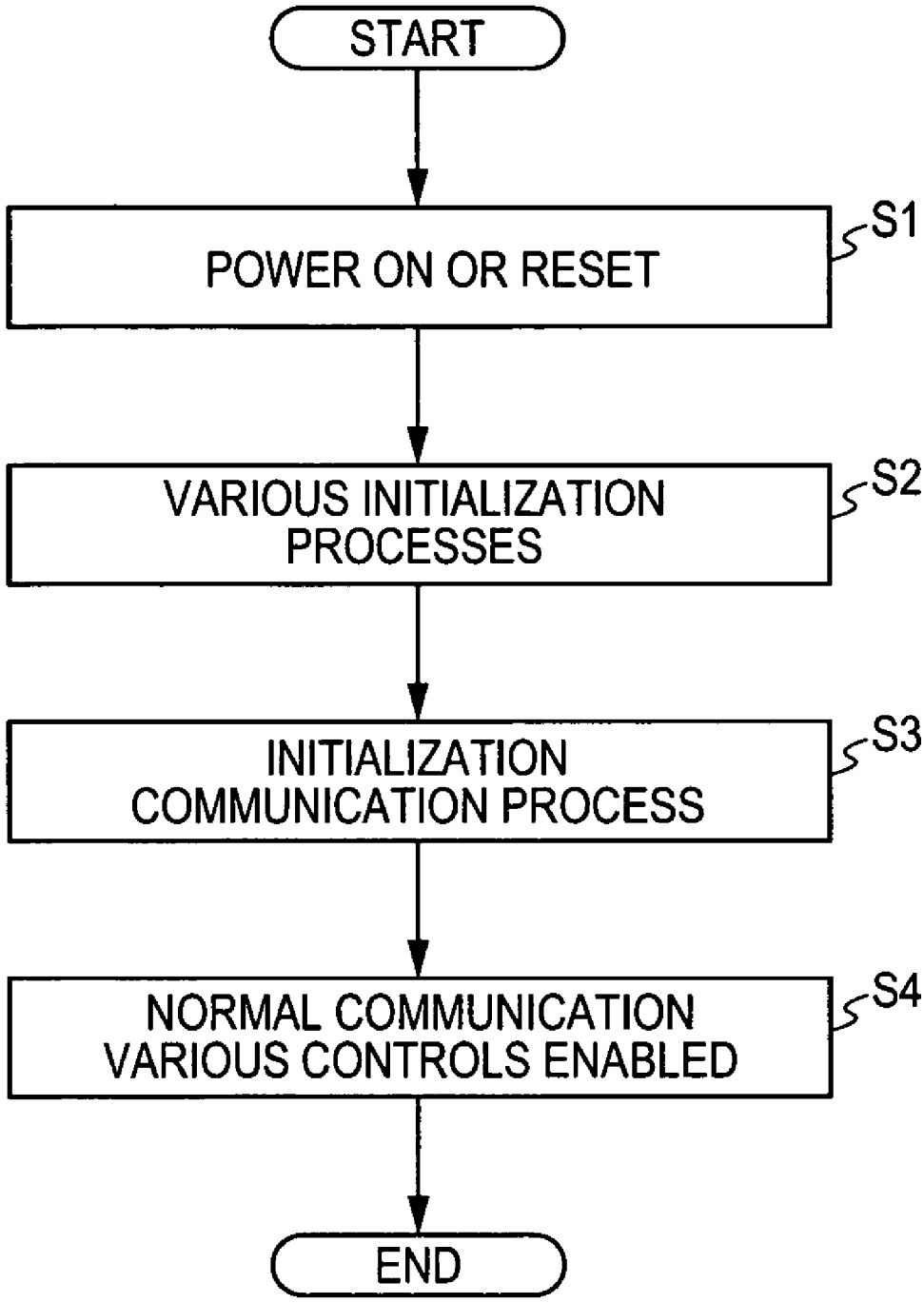
FIG. 8 is a flow chart illustrating a communication process between the main controller and each of OP controllers.

A communication process between the main controller 17 and each of the OP controllers 27, 37, 47, and 57 is described briefly with reference to a flow chart shown in FIG. 8.

When the image forming apparatus is powered on or the image forming apparatus receives an instruction to reset the apparatus (step S1), the main controller 17 and the OP controllers 27, 37, 47, and 57 independently carry out an initialization process (step S2). Thereafter, the main controller 17 carries out an initialization communication process with the OP controllers 27, 37, 47, and 57 to carry out initial settings, such as settings of a plurality of transport speeds (step S3). After the initial settings are completed, the main controller 17 enters a normal communication mode, in which the main controller 17 controls a variety of operations, such as an electrophotographic image forming operation, a paper feed operation in the apparatus body, and a paper feed operation in the optional feeder units (step S4).

Figure 9:
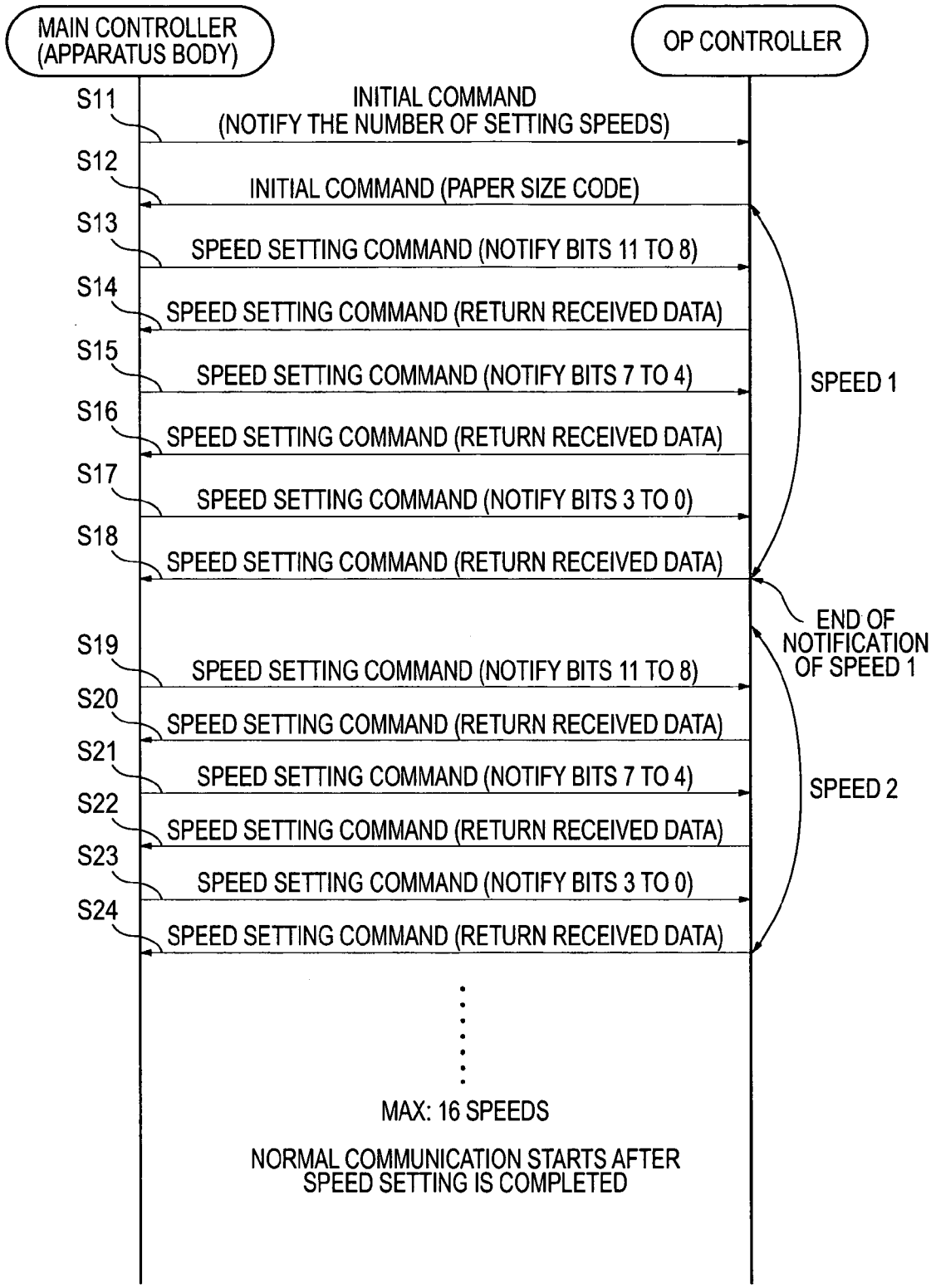
FIG. 9 is a sequence diagram illustrating an initialization communication process shown by step S3 in FIG. 8.

The initialization communication process shown by step S3 in FIG. 8 is described in detail with reference to a sequence diagram shown in FIG. 9.

In the initialization communication process, the main controller 17 transmits a packet associated with the initialization command to notify the number of speed settings shown in FIG. 4A to any one of the OP controllers (the OP controller 57 in this example) (step S11). The OP controller 57 returns a reply packet shown in FIG. 4B containing the size code of recording paper sheets set on the optional paper feeder unit 50 to which the OP controller 57 belongs in response to the packet associated with the initialization command for notifying the number of speed settings (step S12).

The main controller 17 stores the size code of recording paper sheets returned from the OP controller 57 in association with the tier number of the optional paper feeder unit 50 (tier 5 in this example) and sends them to an operation unit (not shown) as needed. The main controller 17 then transmits, to the OP controller 57, a packet associated with a speed setting command shown in FIG. 5A (step S13). This packet contains bits 11 to 8 of 12-bit speed data and the last digits flag of "0".

Figure 5B:
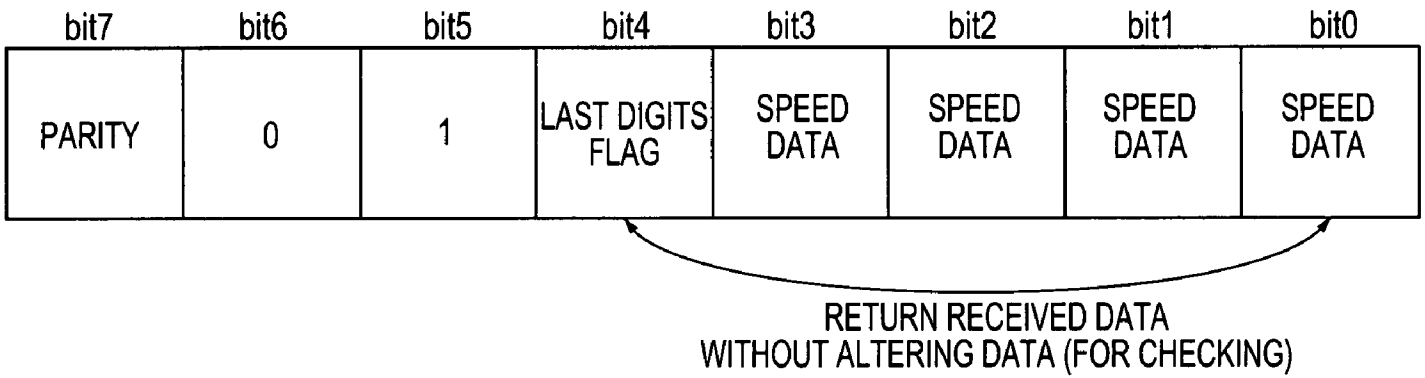
FIG. 5B illustrates the structure of a speed setting reply packet in response to the speed setting command.

The OP controller 57 returns a reply packet shown in FIG. 5B in response to the packet associated with a speed setting command (step S14). The main controller 17 then transmits, to the OP controller 57, a packet associated with a speed setting command shown in FIG. 5A (step S15). This packet contains bits 7 to 4 of the 12-bit speed data and the last digits flag of "0". The OP controller 57 returns a reply packet shown in FIG. 5B in response to the packet associated with a speed setting command (step S16).

Subsequently, the main controller 17 then transmits, to the OP controller 57, a packet associated with a speed setting command shown in FIG. 5A (step S17). This packet contains bits 3 to 0 of the 12-bit speed data and the last digits flag of "1". The OP controller 57 returns a reply packet shown in FIG. 5B in response to the packet associated with a speed setting command (step S18).

Additionally, upon receiving the first 12-bit speed data, that is, upon receiving the packet whose last digits flag is "1", the OP controller 57 recognizes that the speed ID number of the packet received first is "1". The OP controller 57 stores the speed data in association with the speed ID number of "1" in a predetermined memory (not shown).

Subsequently, second speed data is set to the OP controller 57 by repeating the communication that is the same as the process from steps S13 through S18 (steps S19 through S24). In this case, the OP controller 57 stores the speed data received second in association with the speed ID number of "2" in the predetermined memory.

By repeating the above-described speed setting process the number of times notified at step S11, the main controller 17 sets a plurality of transport speeds that the main controller 17 can control to the OP controller 57 of the optional paper feeder unit 50. In addition, the same speed setting process for the OP controller 57 is sequentially carried out for the OP controllers 47, 37, and 27 of the other optional paper feeder units 40, 30, and 20.

As described above, the speed setting process is carried out when the image forming apparatus is powered on or the image forming apparatus receives an instruction to reset the apparatus. That is, the speed setting process is not carried out during an image forming process. Accordingly, although, as described above, the main controller 17 transmits three packets for setting one speed to each OP controller, the image forming speed is not reduced.

Figure 10:
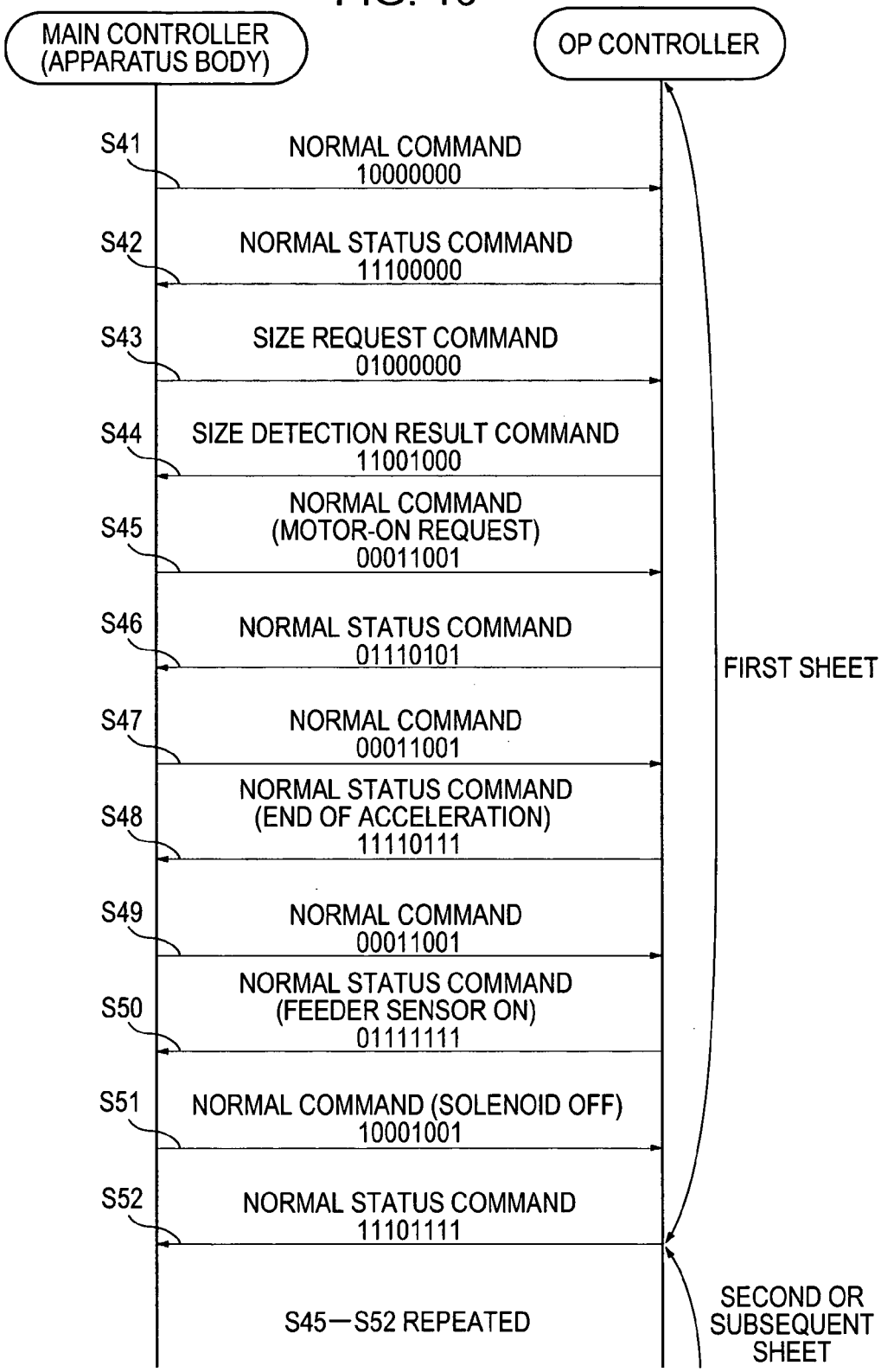
FIG. 10 is a sequence diagram illustrating a communication process in a normal mode shown by step S4 in FIG. 8.

The communication process in a normal mode shown by step S4 in FIG. 8 is described next with reference to a sequence diagram shown in FIG. 10.

In the normal mode, the main controller 17 carries out communication with each of the OP controllers 27, 37, 47, and 57 using a packet associated with a normal command shown in FIG. 6A (step S41) and a packet associated with a normal status reply shown in FIG. 6B (step S42). Subsequently, two types of communication using a packet associated with a size request command shown in FIG. 7A (step S43) and a packet associated with a size detection result status reply shown in FIG. 7B (step S44) are carried out. The communication associated with a size request command is primarily carried out for an operator to recognize the exchange of recording paper sheets during a standby mode.

The main controller 17 requests the OP controller of each of the optional paper feeder units 20, 30, 40, and 50 to turn on a motor when starting each of the motors 24, 34, 44, and 54 of the optional paper feeder units 20, 30, 40, and 50 to form an image (step S45). That is, the main controller 17 transmits a packet associated with a normal command shown in FIG. 6A to each of the OP controllers 27, 37, 47, and 57 of the optional paper feeder units 20, 30, 40, and 50. At the same time, the main controller 17 specifies a transport speed and turns on each of the solenoids 25, 35, 45, and 55 as needed.

For example, to feed a recording paper sheet from the optional paper feeder unit 40, the main controller 17 specifies a transport speed of the motor 44 of the optional paper feeder unit 40. Additionally, the main controller 17 specifies transport speeds of the motors 34 and 24 of the optional paper feeder units 30 and 20, which are disposed in the upper tiers with respect to the optional paper feeder unit 40. Thereafter, the main controller 17 sequentially transmits, to the OP controllers 47, 37, and 27, packets associated with a normal command that turns on the solenoid 45 of the optional paper feeder unit 40 and turns off the solenoids 35 and 25 of the optional paper feeder units 30 and 20 in the upper tier. In response to these requests, each of the OP controllers 47, 37, and 27 of the optional paper feeder unit 40, 30, and 20 returns a reply packet shown in FIG. 6B.

In this case, the main controller 17 can specify a different transport speed for each of the optional paper feeder units depending on the specification of an image forming apparatus. The main controller 17 need not specify the same transport speed for all of the optional paper feeder units. For example, if the distance between the registration roller 19 and each of the optional paper feeder units 40, 30, and 20 is large, the main controller 17 specifies a high speed, a medium speed, and a low speed for the optional paper feeder units 40, 30, and 20, respectively.

After the main controller 17 requests the optional paper feeder unit for feeding a recording paper sheet and the optional paper feeder units in the upper tier to turn on the motors thereof, the main controller 17 communicates with only the optional paper feeder unit for feeding a recording paper sheet to control the paper feed operation. This communication is carried out until a series of the image forming operations for a plurality of recording paper sheets is completed.

That is, the main controller 17 instructs an OP controller (the OP controller 47 in this example) of the optional paper feeder unit for feeding a recording paper sheet (the optional paper feeder unit 40 in this example) to turn on the solenoid 45 and the motor 44 and subsequently transmits a normal packet specifying a speed ID number to the OP controller 47. For example, to specify a speed ID number of "1", the main controller 17 transmits a packet of "00011001" to the OP controller 47. In the packet, bit 4 associated with a solenoid is "1", bit 3 associated with a feeder motor is "1", and bits 2 to 0 associated with a setting speed are "001".

The OP controller 47 returns a normal status reply packet shown in FIG. 6B in response to this packet (step S46). For example, if the solenoid 45 of the optional paper feeder unit 40, to which the OP controller 47 belongs, is turned on, an OP feeder sensor 42 is turned off, a paper presence sensor 43 is turned on (i.e., paper is loaded), and the motor 44 is in an acceleration mode, the OP controller 47 returns a normal status reply packet of "01110101". In the packet, bit 4 associated with the solenoid is "1", bit 3 associated with the OP feeder sensor is "0", bits 2 associated with the presence of paper is "1", and bits 1 to 0 associated with the motor mode are "01".

Additionally, the OP controller 47 reads speed data corresponding to the specified speed ID number "1" out of the memory and drives the motor 44 to transport a recording paper sheet at that speed. By turning on the solenoid 45, a pickup roller of the optional paper feeder unit 40 is brought into contact with a recording paper sheet set on a feeder tray, and therefore, the recording paper sheet is fed from the optional paper feeder unit 40.

Subsequently, the main controller 17 transmits a packet associated with a normal command that is the same as that in step S45 to the OP controller 47 of the optional paper feeder unit 40 in order to recognize the current state of the optional paper feeder unit 40 (step S47).

The OP controller 47 returns a normal status reply packet shown in FIG. 6B in response to the packet (step S48). For example, if only the mode of the motor 44 has changed to a "constant speed" mode (i.e., the acceleration mode is completed) since the previous normal status reply packet was returned at step S46, the OP controller 47 returns a normal status reply packet of "11110111". In the packet, bits 1 to 0 associated with the motor mode are changed to "11" and the other bits remain unchanged.

The main controller 17 recognizes that the motor 44 of the optional paper feeder unit 40 rotates at a constant speed from the returned normal status reply packet. The main controller 17 then transmits a packet associated with a normal command that is the same as that in step S45 or S47 to the OP controller 47 of the optional paper feeder unit 40 in order to recognize the paper feed state of the optional paper feeder unit 40 (step S49).

The OP controller 47 returns a normal status reply packet shown in FIG. 6B in response to the packet (step S50). For example, if only the OP feeder sensor 42 has changed to be turned on since the previous normal status reply packet was returned at step S48, the OP controller 47 returns a normal status reply packet of "01111111". In the packet, bit 3 associated with the OP feeder sensor is changed to "1", and bit 4 and bits 2 to 0 remain unchanged.

The main controller 17 recognizes that the OP feeder sensor 42 of the optional paper feeder unit 40 is turned on from the returned normal status reply packet. That is, the main controller 17 recognizes that a recording paper sheet is fed from the optional paper feeder unit 40. The main controller 17 then transmits a packet associated with a normal command of "10001001" to the OP controller 47 of the optional paper feeder unit 40 (step S51). In the packet, bit 4 associated with the solenoid is changed to "0" in order to turn off the solenoid 45, and the other bits remain unchanged.

The OP controller 47 returns a normal status reply packet shown in FIG. 6B in response to the packet (step S52). In this case, the OP controller 47 of the optional paper feeder unit 40 returns a normal status reply packet of "11101111" in addition to turning off the solenoid 45. That is, since only the solenoid 45 is turned off (bit 4=0), only bit 4 associated with the solenoid is changed to "0", and bits 3 to 0 remain unchanged.

By carrying out the above-described series of communication, the feeding process of a recoding paper sheet is completed. To form an image on a recording paper sheet subsequent from a second sheet, the communication processes described in steps S45 through S52 are repeated between the main controller 17 and the OP controller 47. As can be seen by the foregoing description, in the reply packets, the parity check bit (bit 7) alternately changes in the order of reply.

Thus, when forming an image, the main controller 17 specifies a transport speed by using a speed ID number. Accordingly, by simply transmitting one packet, the transport speed can be specified, and therefore, an amount of communication in an image forming process can be reduced. As a result, the image can be formed at high speed. In other words, the main controller 17 can control the optional paper feeder units 20, 30, 40, and 50 to rapidly start a paper feed or transport operation, and therefore, the image can be formed at high speed.

In addition, the main controller 17 transmits a normal command containing a speed ID number not only at step S45 but also at steps S47 and S49. However, the transmission (and the reception in response to the transmission) of the normal command at steps S47 and S49 is carried out during the paper feed or transport operation of the optional paper feeder unit. The paper feed or transport operation is not interrupted by the transmission of the normal command. Consequently, although the normal command is transmitted at steps S47 and S49 and its reply is received at steps S48 and S50, the speed of the image forming process is not reduced.

Furthermore, the main controller 17 controls the series of paper feed and transport operation of each of the optional paper feeder units 20, 30, 40, and 50. That is, since the image forming apparatus body 10 stores programs for the series of paper feed and transport operation, each of the optional paper feeder units 20, 30, 40, and 50 need not independently store the complicated programs for processing transport speeds and paper feed and transport sequences of a plurality of models. Thus, the cost of the image forming apparatus can be reduced.

Still furthermore, the main controller 17 not only controls the series of paper feed and transport operation but also sets a plurality of transport speeds to the OP controllers 27, 37, 47, and 57 in advance. Thus, the transport speeds and the paper feed and transport sequences can be simply and flexibly changed.

The present invention is not limited to the above-described embodiments. For example, the present invention can be applied to a sorter/finisher and an automatic document feeder apparatus when they specify a transport speed to their accessories (peripheral units). In addition, the present invention can be applied to a fixed paper feed cassette, a sorter/finisher, and a peripheral unit of an automatic document feeder apparatus in addition to the optional unit.

The present invention can be achieved by supplying a storage medium (or a recording medium) storing software program code that achieves the functions of the above-described embodiments to a system or an apparatus. That is, the present invention can be achieved by causing a computer (central processing unit (CPU) or micro-processing unit (MPU)) of the system or apparatus to read the program code stored in the storage medium and execute the program code. In this case, the program code itself read out of the storage medium realizes the function of the above-described embodiments and the storage medium storing the program code can realize the present invention.

The functions of the above-described embodiments can be realized by another method in addition to executing the program code read out by the computer. For example, the functions of the above-described embodiments can be realized by a process in which an operating system (OS) running on the computer executes some of or all of the functions in the above-described embodiments under the control of the program code.

The present invention can also be achieved by writing the program code read out of the storage medium to a memory of an add-on expansion board of a computer or a memory of an add-on expansion unit connected to a computer. For example, the functions of the above-described embodiments can be realized by a process in which, after the program code is written, a CPU in the add-on expansion board or in the add-on expansion unit executes some of or all of the functions in the above-described embodiments under the control of the program code. When the present invention is applied to the above-described storage medium, the storage medium stores program code corresponding to the flow chart shown in FIG. 8 and the sequence diagrams shown in FIGS. 9 and 10.

According to an embodiment of the present invention, there are provided an image forming apparatus, a method for controlling the image forming apparatus, and a program that can set a plurality of transport speeds to a peripheral unit having a function to transport a recording medium in low cost and that can form an image at high speed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-330997 filed Nov. 15, 2004, which is hereby incorporated by reference herein in its entirety.

What is claimed is:

1. An image forming apparatus connectable to a peripheral unit operable to transport a recording medium, the image forming apparatus comprising:

a communication device facilitating communication with the peripheral unit; and a controller controlling transporting the recording medium by the peripheral unit using communication from the communication device, wherein the controller sets a plurality of transport speeds, each of which corresponds to a predetermined identification code, to the peripheral unit and specifies the transport speed by using the predetermined identification code to the peripheral unit, wherein the controller transmits a number of transport speeds to be set to the peripheral unit before the controller transmits the transport speed to the peripheral unit, and wherein the peripheral unit returns a size of the recording medium set on the peripheral unit responsive to the peripheral unit receiving the number of transport speeds transmitted from the controller.

2. The image forming apparatus according to claim 1, wherein a data length of the identification code is shorter than a data length of the transport speed.

3. The image forming apparatus according to claim 1, wherein the controller transmits only the transport speed to the peripheral unit without transmitting the identification code, and wherein the peripheral unit recognizes the identification code of the transport speed on the basis of the order of receiving the transport speed and stores the received transport speed in association with the recognized identification code.

4. The image forming apparatus according to claim 1, wherein the peripheral unit directly returns data including the transport speed transmitted by the controller to the controller without altering the data.

5. The image forming apparatus according to claim 1, wherein the controller specifies an operation of a transport system of the peripheral unit at the same time the controller specifies the transport speed using the identification code.

6. The image forming apparatus according to claim 1, wherein the peripheral unit returns a state of the transport system of the peripheral unit responsive to the controller specifying the transport speed using the identification code.

7. The image forming apparatus according to claim 1, wherein the peripheral unit includes an optional feeder unit capable of being electrically connected to different optional feeder units in different tiers.

8. The image forming apparatus according to claim 7, wherein the controller identifies the optional feeder unit when the controller communicates with the plurality of optional feeder units by using a strobe signal.

* * * * *